US009114502B2

(12) United States Patent
Brooks et al.

(10) Patent No.: US 9,114,502 B2
(45) Date of Patent: Aug. 25, 2015

(54) GRINDER SAFETY REST WITH SPECIAL SHAPE ADJUSTMENT APPARATUS

(75) Inventors: Edward L. Brooks, Hurricane, WV (US); James Glenn Conrad, Evans, WV (US); Emery J. Beever, Lesage, WV (US); Malinda K. Dowdy, Tornado, WV (US); Casey Lee Mabry, Culloden, WV (US); Jamie Joe Barton, Hurricane, WV (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 210 days.

(21) Appl. No.: 13/559,044

(22) Filed: Jul. 26, 2012

(65) Prior Publication Data

US 2014/0030968 A1 Jan. 30, 2014

(51) Int. Cl.
*B24B 41/06* (2012.01)
*B24B 27/02* (2006.01)

(52) U.S. Cl.
CPC ..... *B24B 41/06* (2013.01); *B24B 27/02* (2013.01)

(58) Field of Classification Search
CPC .... B24B 41/06; B24B 41/065; B24B 41/066; B24B 41/068; B24B 49/183; B24B 27/02
USPC ..... 451/406
See application file for complete search history.

(56) References Cited

U.S. PATENT DOCUMENTS 1,081,465 A * 12/1913 Pribnow ..... 451/342
1,224,593 A * 5/1917 Bengtsson ..... 451/375
1,430,426 A * 9/1922 Zongaro ..... 451/406
1,448,746 A * 3/1923 Hunt et al. ..... 451/406
2,167,615 A * 7/1939 Silven ..... 451/408
2,176,726 A * 10/1939 Shepherd ..... 451/410
2,202,819 A * 6/1940 Yantiss ..... 451/375
2,415,676 A * 2/1947 Duckwitz ..... 451/406
2,419,170 A * 4/1947 Silven ..... 451/408
2,425,982 A * 8/1947 Bazley ..... 451/273

(Continued)

FOREIGN PATENT DOCUMENTS

JP 2006167873 A 6/2006

OTHER PUBLICATIONS

Article entitled Veritas® Grinder Tool Rest, from Veritas® Tools Inc.; web site http://www.veritastools.com/Products/Page.aspx?p=127; dated Apr. 19, 2012.

*Primary Examiner* — Joseph J Hail
*Assistant Examiner* — Brian Keller
(74) *Attorney, Agent, or Firm* — Christopher G. Darrow; Darrow Mustafa PC

(57) ABSTRACT

An adjustable safety rest for grinding wheel includes a notch in one of a base edge defining side walls and an inner wall conformable in a spaced relationship around outer side edges and the outer edge of a grinding wheel. A wheel edge gap conformable member or special shape member is mounted in a base fixed to the grinder and is axially adjustable in position to maintain a first end of member in a fixed spaced dimensional relationship relative to one portion of the outer surface of the grinding wheel as the grinding wheel undergoes wear. The member may be disposed in a recess in the base at a 45° degree angle intersecting at least one inner corner of the notch in the base. The member may also be centrally mounted on the base to intersect only the inner wall of the base.

18 Claims, 7 Drawing Sheets

(56) References Cited

U.S. PATENT DOCUMENTS

| | | | | | |
|---|---|---|---|---|---|
| 2,555,707 | A | * | 6/1951 | Scott | 451/410 |
| 2,566,893 | A | * | 9/1951 | Jones, Sr. | 451/276 |
| 2,574,499 | A | * | 11/1951 | Ruscitti et al. | 76/41 |
| 2,887,833 | A | * | 5/1959 | Passarotti | 451/367 |
| 3,144,735 | A | | 8/1964 | McCarty et al. | |
| 3,373,530 | A | * | 3/1968 | Cooprider | 451/406 |
| 3,501,871 | A | * | 3/1970 | Anderson et al. | 451/406 |
| 3,782,046 | A | * | 1/1974 | Schaap et al. | 451/406 |
| 4,020,601 | A | * | 5/1977 | Gray | 451/6 |
| 4,349,990 | A | * | 9/1982 | St. Denis | 451/369 |
| 5,123,213 | A | * | 6/1992 | Vinson | 451/245 |
| 5,172,484 | A | * | 12/1992 | Triola | 33/534 |
| 5,337,522 | A | * | 8/1994 | Chien | 451/414 |
| 5,525,095 | A | * | 6/1996 | Baughman | 451/72 |
| 8,439,727 | B1 | * | 5/2013 | Woodard | 451/375 |
| 2002/0086629 | A1 | * | 7/2002 | Rizzo et al. | 451/406 |
| 2012/0270479 | A1 | * | 10/2012 | Batty | 451/410 |
| 2014/0030968 | A1 | * | 1/2014 | Brooks et al. | 451/406 |
| 2014/0113530 | A1 | * | 4/2014 | Orlando | 451/241 |

* cited by examiner

FIG. 4
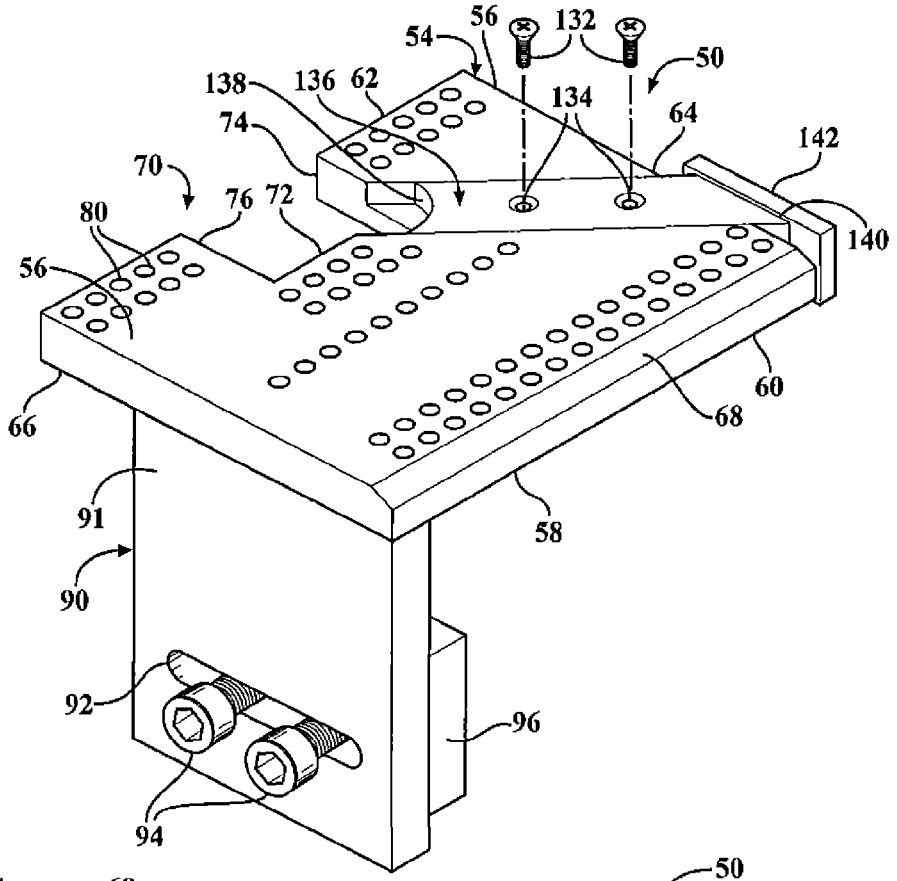
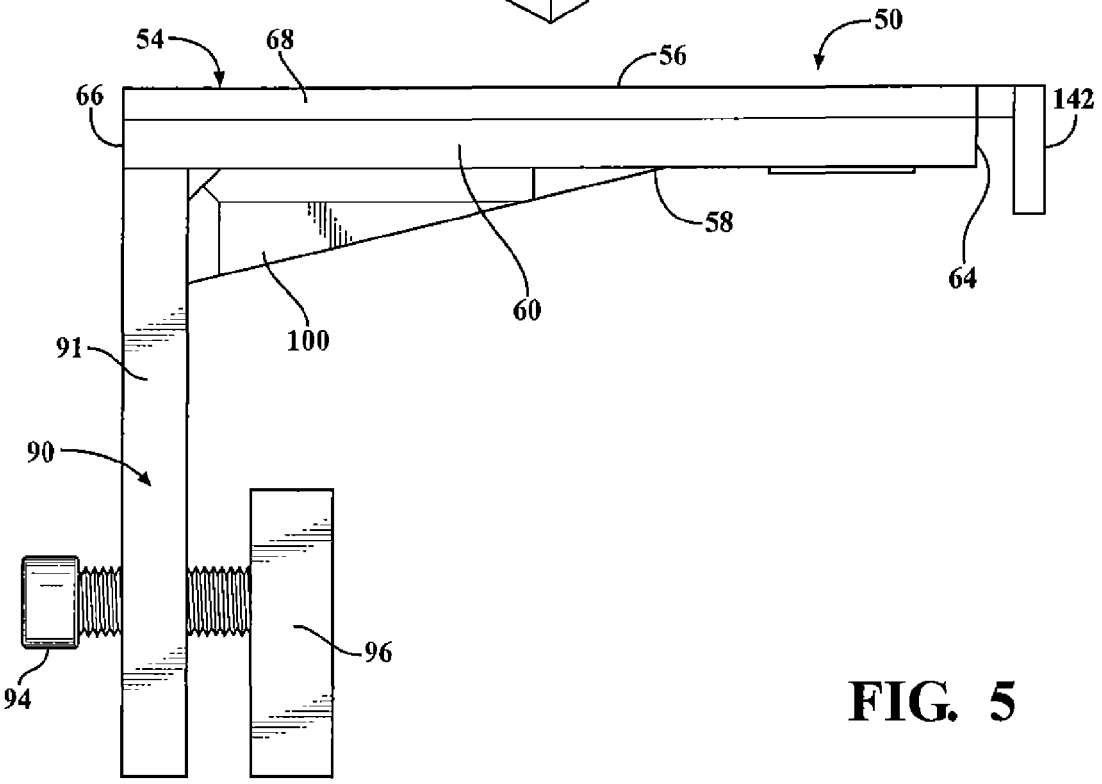
FIG. 5

GRINDER SAFETY REST WITH SPECIAL SHAPE ADJUSTMENT APPARATUS

BACKGROUND

This invention relates, in general, to tool grinders and, more particularly, to safety rests for tool grinders.

Grinding wheels are employed in tool fabrication to smooth the surfaces of tools or parts during the fabrication of the tools or machine parts.

A typical bench grinder has one or two side-by-side, rotatable grinding wheels formed of abrasive material. A safety rest is mounted in front of each grinding wheel to provide a stationary surface for the operator to rest the part being ground.

OHSA regulation 191.215A4 requires a 1-3 mm gap between the grinding wheel and the safety rest to prevent equipment damage or bodily injury to the operator.

Typical safety rests have a straight edge facing the originally flat outer circumferential edge of the grinding wheel or a U-shaped notch in the straight edge of the safety rest which surround the originally flat front edge and a portion of the adjacent outer sides of the grinding wheel. The entire safety rest can be adjusted to maintain the required 1-3 mm spacing as the outer edge of the grinding wheel wears.

However, the notches in the safety rest have flat perpendicularly oriented sides to accommodate the original perpendicularly oriented flat sides and end surface of a new grinding wheel. The flat edge surface of the safety rest can be adjusted, as described above, relative to the grinding wheel as the flat end surface of the grinding wheel wears away in order to maintain the required 1-3 mm safety gap.

However, special shaped wheels which do not have a flat corner between the front edge and the sides of the grinding wheel or a wearing down of the originally flat corner of a grinding wheel by operators using the edge of the grinding wheel for smoothing radius cuts, etc., cause the originally flat corner edge of the grinding wheel to wear away into a curved radius. This curved radius edge on the grinding wheel becomes spaced further and further away from the corresponding inner corner edge of the safety rest as the grinding wheel edge wears away. This opens a gap larger than that required by safety regulations.

It will be desirable to provide a grinding wheel safety rest which accommodates grinding wheel edge wear or grinding wheels having special edge shapes during the useful life of the grinding wheel.

SUMMARY

An adjustable safety rest for a grinder wheel rotatably mounted on a fixed support includes a base, an inward extending notch formed in one edge of the base and defining two side walls and an inner wall, the inner wall connected to the sidewalls at inner corners, and a gap control member having a grinding wheel edge conformable end surface adjustably mounted in the base and intersecting one portion of the notch.

A groove is formed in the base and adjustably receiving the gap control member.

A longitudinal axis of the recess and the gap control member intersect one of the inner corners of the recess in the notch in the base at a substantially 45° angle.

In another aspect, an axis of the recess and the gap control member intersect the inner wall of the notch in the base.

The safety rest includes a mounting plate is fixed to the base and attachable to the fixed support. The mounting plate has at least one threaded bore, a slot carried in the plate and a fastener extendable through the slot into the bore in the plate for mounting the plate and the base on the fixed support. The slot, the fastener, and the mounting plate cooperate to allow adjustment of the mounting plate relative to the fixed support.

The gap control member includes a slide plate. Fasteners are engageable with the slide plate and the base to adjustably fix the slide plate in the selected position along the axial extent of the recess in the base.

A stop member can be fixed to a second end of the slide plate for limiting axial movement of the slide plate relative to the base in one direction.

In one aspect, the first end of the slide plate has an arcuate shape. In another aspect, the first end of the slide plate has a concave arcuate shape. In another aspect, the first end of the slide plate has a linear shape.

In one aspect, the safety rest has a special shape member adjustably fixedly coupled to a base for adjustable repositioning of a first edge of the special shape member relative to the base to maintain predetermined gap between the first edge of the special shape member and an adjacent edge of a grinding wheel.

The safety rest has a groove formed in the base, with the special shape member adjustably moveable in the groove.

The safety rest has a mount coupled to the base and adjustably positionably fixable to support structure surrounding a grinding wheel. The mount is repositionable to maintain the two side walls and the inner end wall of a notch in the base at a predetermined gap spacing from adjacent edges of a grinding wheel.

BRIEF DESCRIPTION OF THE DRAWING

The various features, advantages and other uses of the present grinding wheel safety rest will become more apparent by referring to the following detailed description and drawing in which:

FIG. 4 is a perspective view of one aspect of the safety rest;

FIG. 5 is a front elevational view of the safety rest shown in FIG. 4;

DETAILED DESCRIPTION

Figure 1:
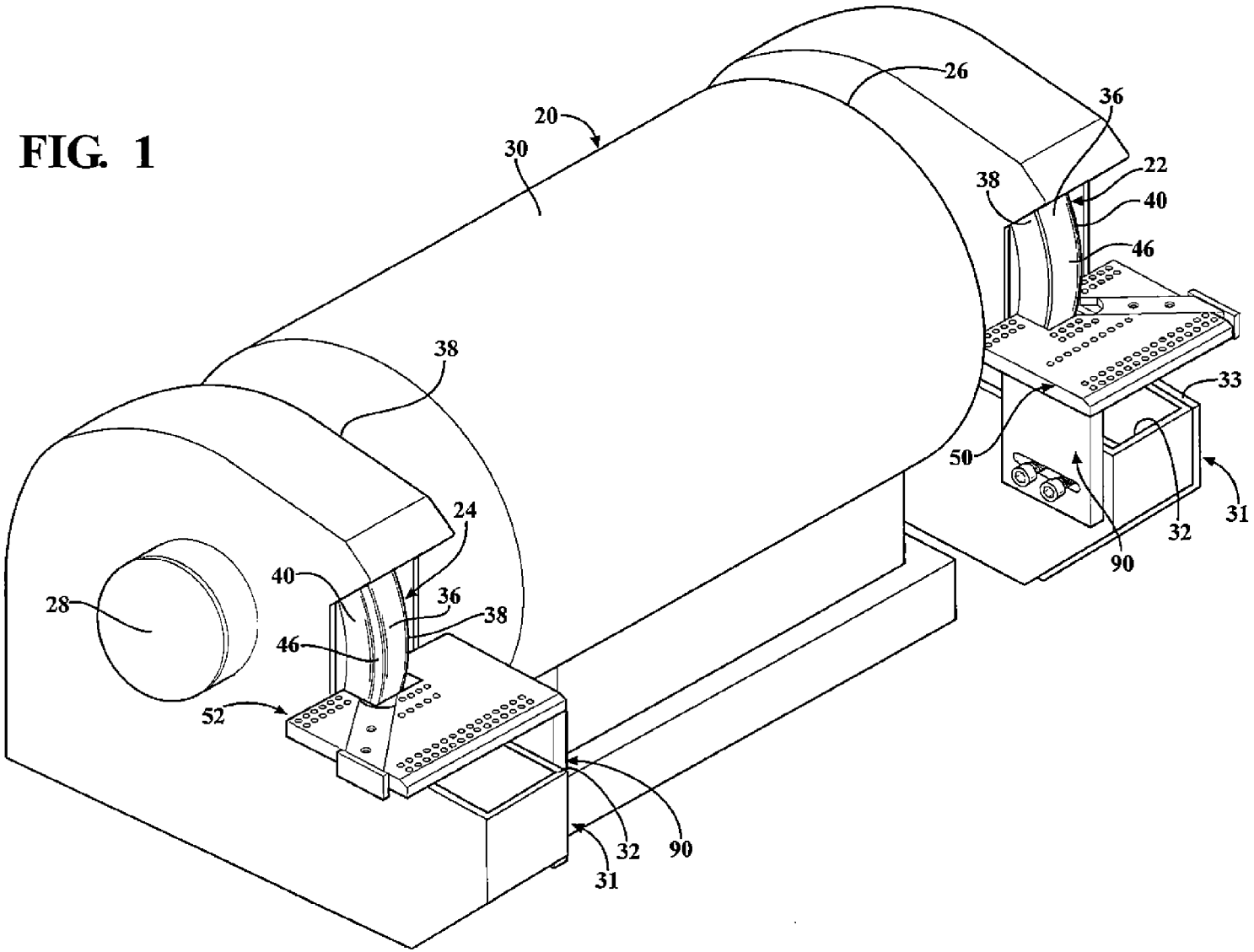
FIG. 1 is a perspective view of a bench grinder using a safety rest with special shaped adjustment.

Referring now to FIGS. 1-9, there is depicted, by way of example only, a bench grinder 20 rotatably driving at least one and, as shown in FIG. 1, two grinding wheels 22 and 24. Grinding wheels 22 and 24 are mounted on separately rotatable spindles 26 which are coupled to an electric motor housed within a grinder housing 30.

A wheel shield 31 is fixed to the housing 30 of the bench grinder 20 and is disposed in a surrounding or encompassing position with respect to each grinding wheel 22 and 24. The shield 31 has a cut away opening 32 along the front edge allowing access to a front position of the grinding wheel 22 or 24. For safety, the shield 31 has opposed sidewalls and edges all denoted by reference number 33 which surround a major portion of the grinding wheel 22 or 24.

Figure 9:
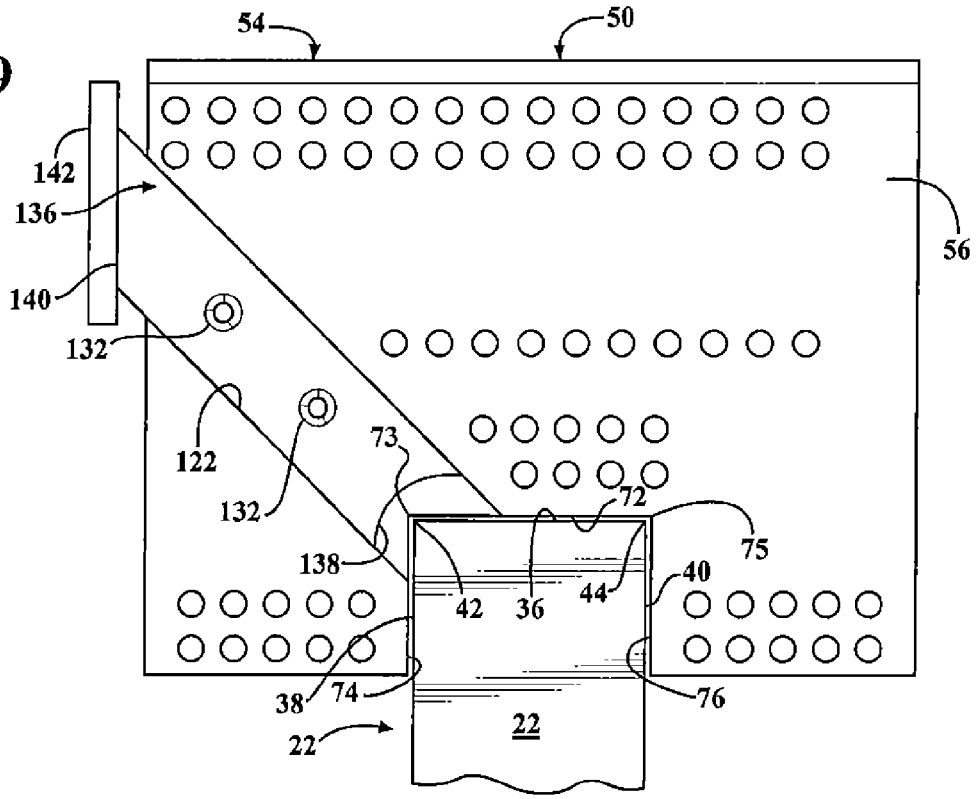
FIG. 9 is a pictorial representation of the orientation of the safety rest relative to a new grinding wheel.

Each grinding wheel 22 and 24, as shown in FIG. 9 for the grinding wheel 22, when in an original, new state, has a flat outer circumferential edge 36 and opposed sides 38 and 40. In an original, new state, the outer edge 36 and the sides 38 and 40 form sharp, 90° outer corners or corner edges 42 and 44 at the intersection of the ends of the outer edge 36 and the sides 38 and 40.

Figure 10:
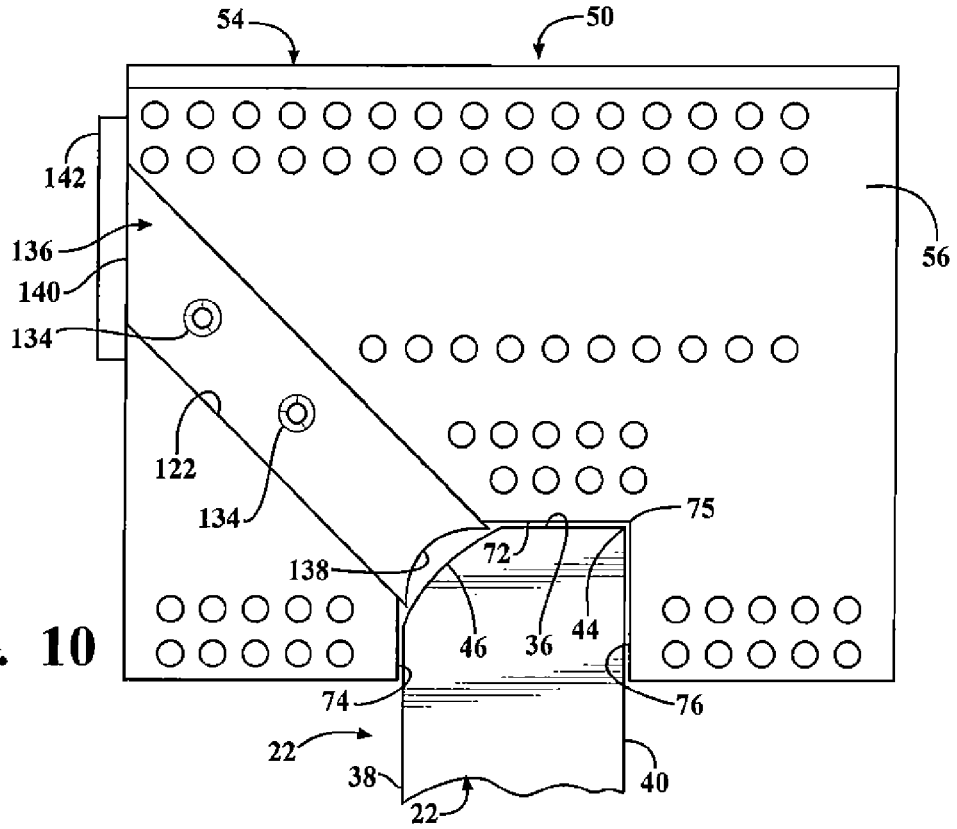
FIG. 10 is pictorial representation showing the adjustment of the special adjustment shape relative to the safety rest base and a grinding wheel having a worn curved edge.

However, during use, at least one of the corner edges, such as the corner edge 44 located further away from the housing 30 than the opposed inner corner edge 42, experiences extreme wear thereby rounding off the original sharp corner edge 44 to a curved or arcuate radiussed edge 46 shown in FIGS. 1 and 10.

Figure 2:
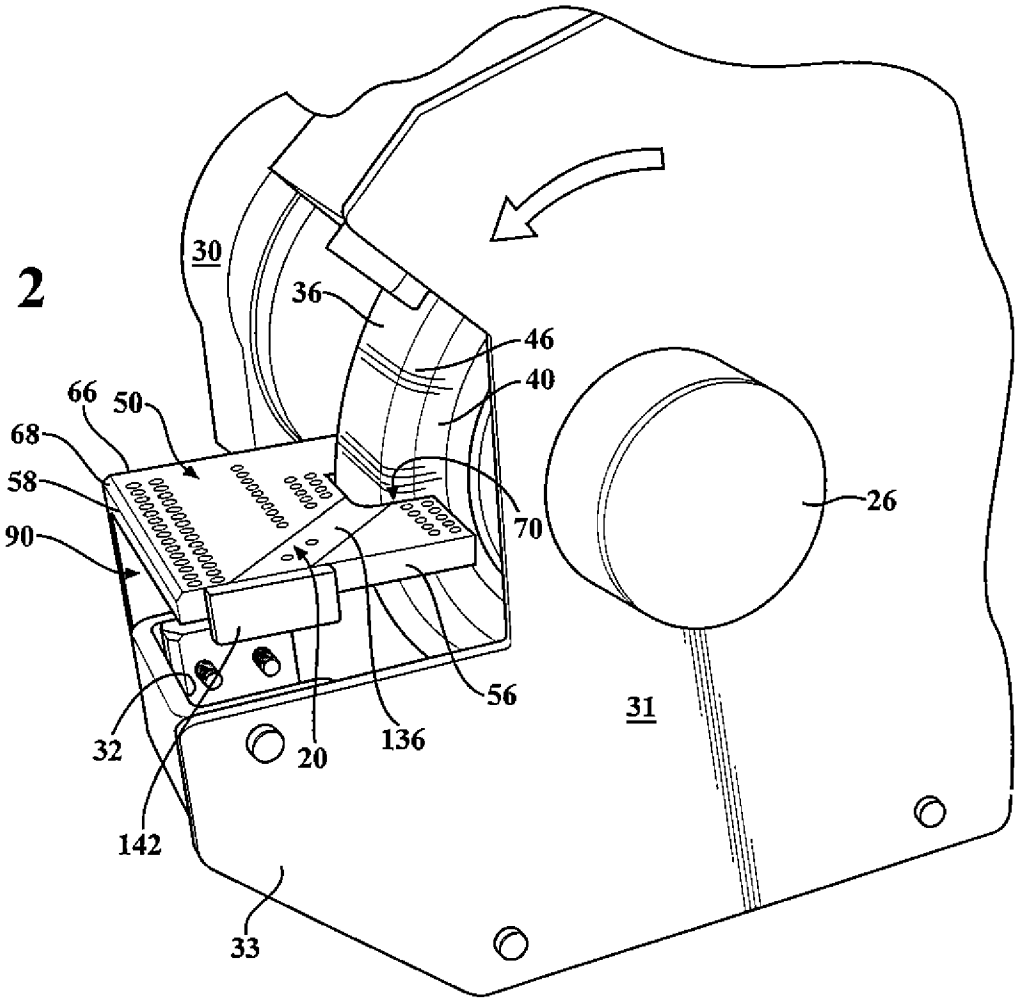
FIG. 2 is an enlarged, right side perspective view of the right side grinding wheel and safety rest shown in FIG. 1.
Figure 3:
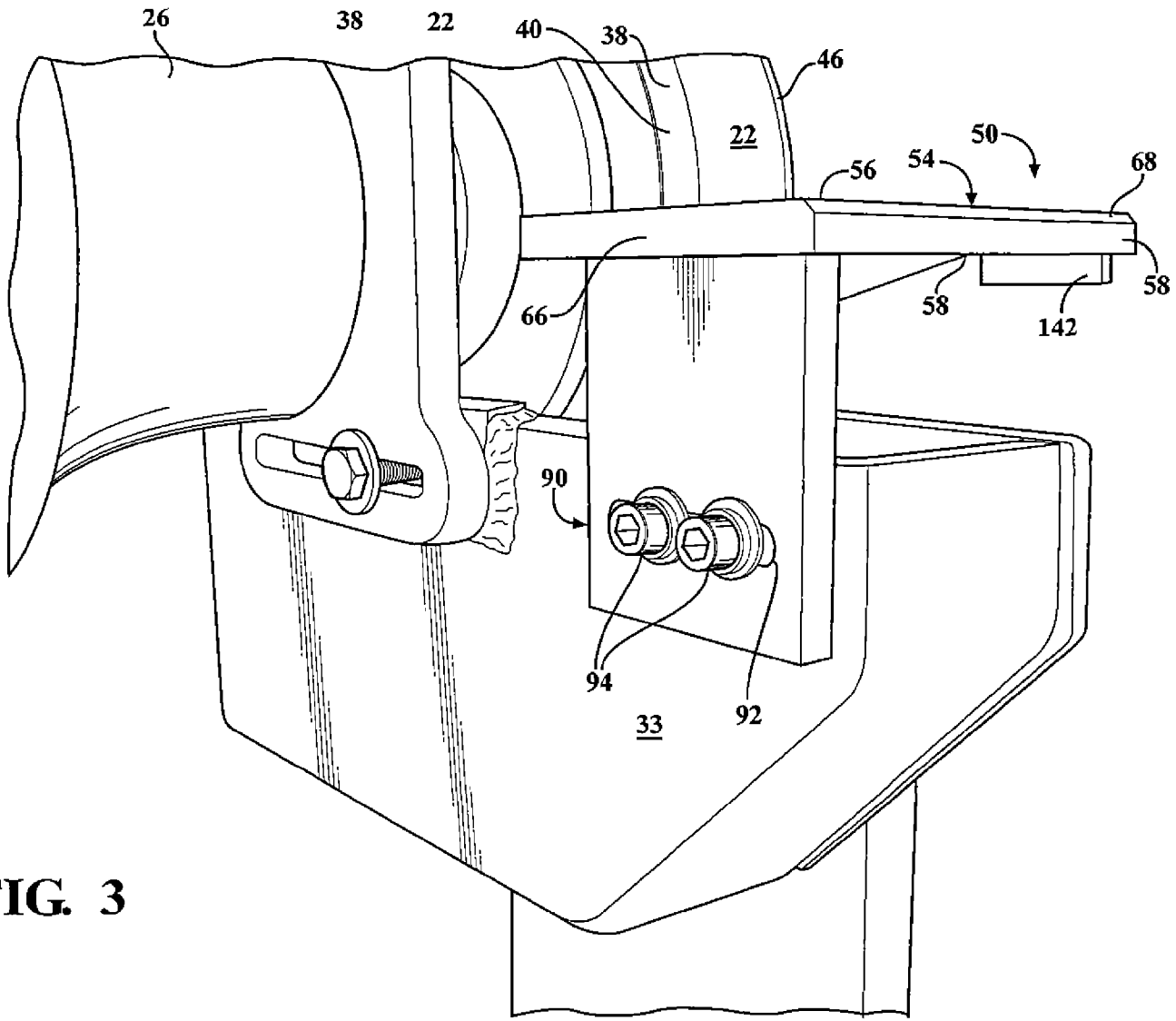
FIG. 3 is an enlarged, left side perspective view showing the attachment of the safety rest to the grinding wheel housing.
Figure 6:
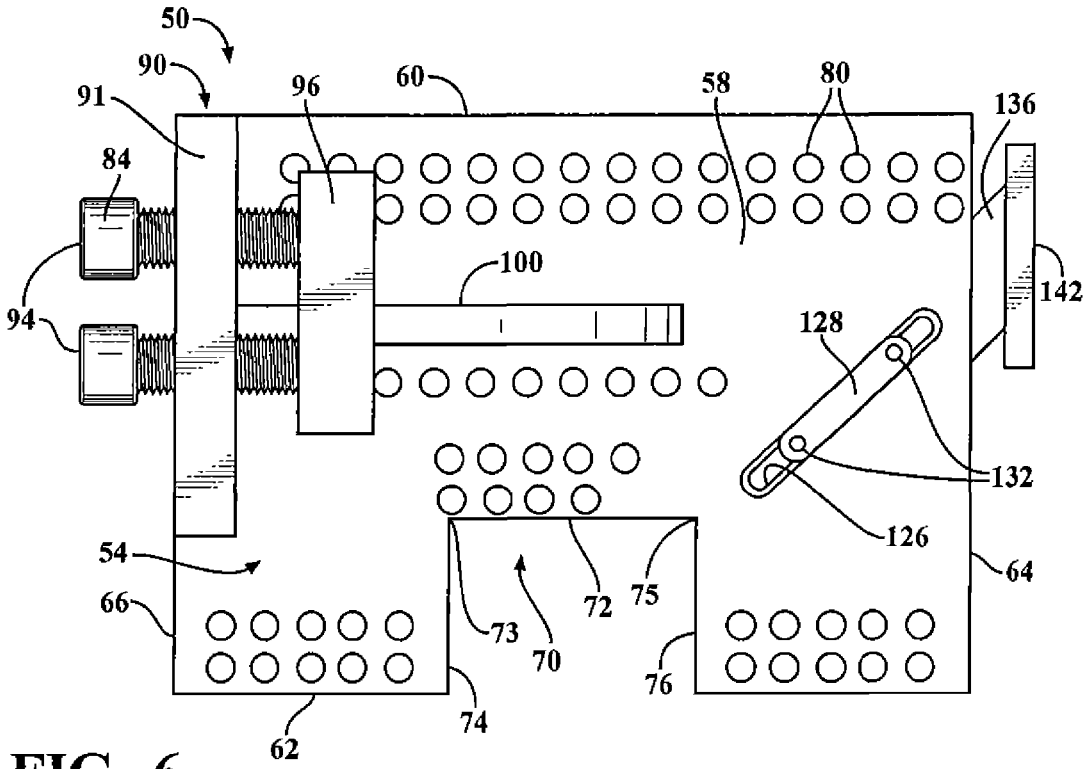
FIG. 6 is a plan view of the safety rest shown in FIG. 4.
Figure 7:
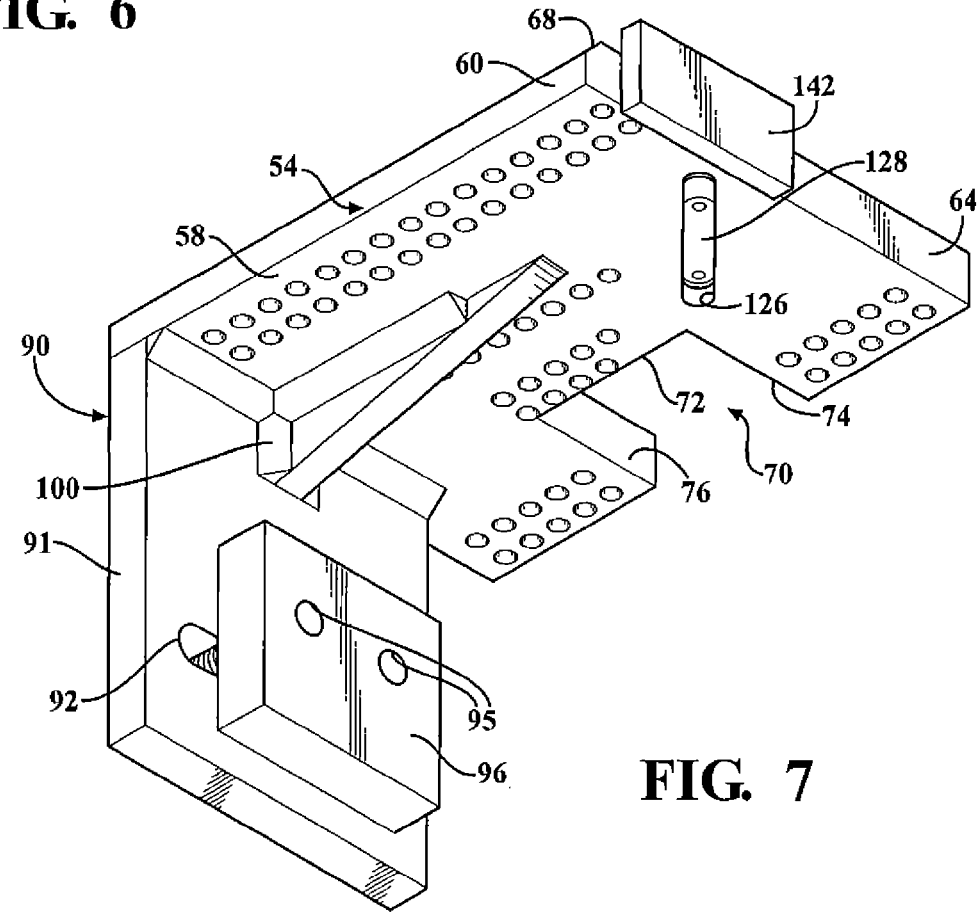
FIG. 7 is a bottom right side perspective view of the safety rest shown in FIG. 4.
Figure 8:
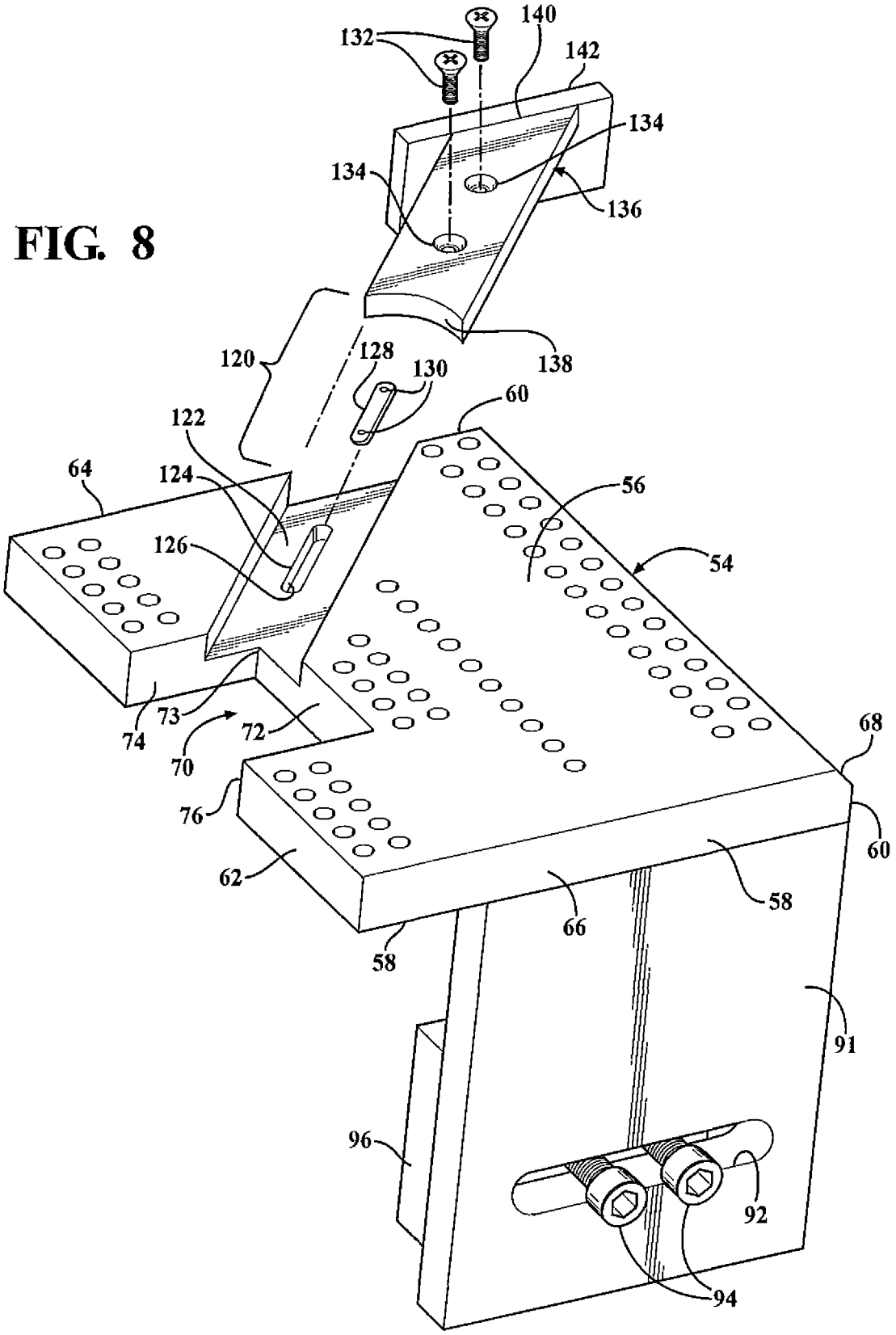
FIG. 8 is an exploded perspective view showing the attachment of the special shape apparatus to the base of the safety rest shown in FIG. 4.

Referring now to FIGS. 1-3 and, in greater detail to FIGS. 4-8, there is depicted an adjustable safety rest or grinder guard apparatus 50 associated with the grinding wheel 22. A mirror image adjustable safety rest or grinder guard apparatus 52 is associated with the other grinding wheel 24.

The apparatus 40 includes a base 54 having a generally planar or flat shape defined by a top surface 56, an opposed bottom surface 58, first and second opposed edges 60 and 62 interconnected at opposite ends by sides 64 and 66. The first edge 60, which is a front edge with respect to the normal operating position of the safety rest 50 with respect to the grinding wheel 22, has an angled chamfer 68 between the front edge 60 and the top surface 56.

A plurality of small bores 80 are formed in the base 54 and extend completely through the base 54 to the top surface 56 to the bottom surface 58. The bores 80 allow grinding dusts and sparks to pass through the base 54 instead of bouncing up towards the operator. Typical grinding machines have a dust collector with a vacuum mounted below the grinder wheel 22 to draw and capture the dust as it falls through the base 54.

A U-shaped notch 70 is formed in the second edge 62 of the base 54. The second edge 62 is also referred to as rear or back edge in the normal mounting position of base 54 relative to the grinding wheel 22. The notch 70 is generally located intermediate to the opposed sides 64 and 66 of the base 54.

The notch 70 is defined by a generally planar inner end wall 72 and opposed side walls 74 and 76. The side walls 74 and 76 of the notch 70 are spaced apart a sufficient distance to provide a 1-3 mm gap between the surfaces of the side walls 74 and 76 and the adjacent sides 38 and 40 of the grinding wheel 22 when the safety rest 50 is in its normal mounting position surrounding a front portion of the grinding wheel 22 as shown in FIG. 1.

The inner wall 72 and the side walls 74 and 76 of the notch 70 form inner corners 73 and 75 respectively at the junctions of the ends of the sidewall 74 and one end of the inner wall 72, and at the other end of the inner wall 72 and the opposed side wall 76. Generally, the inner wall 72 and the side walls 74 and 76 of the notch 70 form 90° corners 73 and 75.

A mounting support or leg 90, generally in the form of a flat plate 91, is fixed to the bottom surface 58 of the base 54, generally along one side, such as side 66 of the base 54. The plate 91 extends downward from the bottom surface 58 relative to the normal mounting position of the safety rest 50.

An elongated slot 92 is formed in the plate 91. One or more fasteners, with two fasteners 94 shown by way of example only in FIGS. 4 and 5, extend through the slot 92 into tapped holes 95 in a back plate 96. Threading and unthreading of the fasteners or bolts 94 enables the distance or space between the plate 91 and the back plate 96 to be adjusted to fix the entire safety rest 50 on the sidewall 33 on the shield 31 surrounding the grinding wheel 22. The fasteners or bolts 94 may be loosened and the entire safety rest 50, the plate 91 and the back plate 96 adjusted in an adjacent direction toward the grinding wheel 22 to maintain the safety gap of 1-3 mm between the surfaces of the base 54 and the grinding wheel 22 as the grinding wheel 22 experiences wear.

A support rib 100, which is illustrated as having a generally triangular shape by example only, can be fixed, such as by welding, to the bottom surface 58 of the base 54 and an inner surface of the leg 90 to maintain a substantially perpendicular angle between the base 54 and the leg 90.

As shown in FIGS. 1, 3, 4, 6, 8, 9, and 10 the safety rest includes an adjustable special shape apparatus or gap control member 120 which maintains the required 1-3 mm gap between all portions of the inner walls 72, 74 and 76 of the notch 70 and the adjacent surfaces of the grinding wheel 22 when the grinding wheel 22 has a special exterior shape or experiences a shape change due to wear. A groove 122 is recessed into the top surface 56 of the base 54. The groove 122, which is shallower than the overall depth of the base 54 between the top and bottom surfaces 56 and 58, may, in one application, be mounted substantially at a 45° angle with respect to the inside corner 73 between the inner end wall 72 and the side wall 74 of the notch 70. At this angle, the longitudinal axis of the groove 122 intersects the original sharp outer corner edge 44 of the grinding wheel 22.

A slot 124 is formed along the longitudinal axis of the groove 122 in the base 54 through the top surface 56 and the bottom surface 58 of the base 54. The slot 124 extends inward into the base 54 from the top surface of the groove 122 has a first diameter sufficient to receive the threaded shaft of adjustable screws. The slot 124 opens to a larger slot 126 extending from the bottom surface 58 of the base 54. The larger size slot 126 receives a slide lock 128 having a pair of apertures 130.

The adjustably positionable special shape member can be in the form of a slide 136. The slide 136 is sized to fit flush within the groove 122 and has a first end 138 and an opposed second end 140. An enlarged stop plate 142 is attached, such as by fasteners or welding, to the second end 140 on the slide 136. The slide 136 includes a pair of spaced chamfered bores 134 which receive the fasteners 132 in a flush arrangement. The fasteners 132 extend through the bores 134 and into the bores 130 in the slide lock 128 to allow adjustable positioning of the slide 136 in the groove 122 as described hereafter.

The different diameter portions of the slots 124 and 126 and the sidewalls of the groove 122 cooperate with the slide plate 136 to allow adjustable movement of the slide 136 along the axial length of the groove 122 between selectable positions to adjust the position of the first end 138 of the slide 136 at the predetermined required safety gap of 1-3 mm from the adjacent edge 44 of the grinding wheel 22, as the edge 46 of the grinding wheel 22 wears during use.

As shown in FIGS. 1, 4, and 9, the first end 138 of the slide 136 will initially be positioned in a fixed location in the groove 122 such that the first end 138 is located over the lower surface of the recess 122 and spaced from inner corner 73 of the notch 70. This allows the inner corner 75 of the notch 70 between adjoining edges of the inner wall 72 and the side wall 74 to provide the required 1-3 mm small gap spacing between the safety rest 50 and all of the exterior portions of the grinding wheel 22.

However, as shown in FIG. 9, through particular use of the outer corner edge 42 of the grinding wheel 22, the outer corner edge 42 will wear away and take a more rounded or arcuate shape 46 as shown in FIG. 10. Gradually, as the inner corner 73 of the notch 70 becomes increasingly spaced from the corner edge 42 of the grinding wheel 22 as the corner edge 42 wears away, the adjustable slide plate 136 can be released through unthreading of the fasteners 132, slid in a direction along the groove 122 toward the grinding wheel 22 and again tightened into a fixed position to maintain the first end 138 of the slide plate 136 in the desired 1-3 mm spacing with respect to the adjacent corner 46 of the grinding wheel 22.

It will be understood that since the typical wear of the originally sharp edge 42 of the grinding wheel 22 is to the arcuate shape 46 shown in FIG. 10, the first end 138 of the slide plate 136 can have a complimentary curved or arcuate shape. This will maintain all portions of the curved edge 46 of the grinding wall 22 spaced the required 1-3 mm distance from the first end 138 of the slide 136

It will also be understood that the first end 138 of the slide plate 136 can have other shapes so as to conform to a grinding wheel having a special edge shape, such as a 45° corner, or an original curved arcuate shape, etc.

As shown in FIGS. 1 and 2, the adjustable safety rest 52 with special adjustable apparatus for the grinding wheel 24 is constructed in a mirror image from the adjustable safety rest 50 described above. When viewed in plan, in the adjustable safety rest 52, the grooves 122 and the slide 136 are still oriented at 45° angle to the outer edge 42 of the grinding wheel 24. However, due to the left side mounting of the grinding wheel 24 on the bench grinder 20, the recess 122 on the slide plate 136 are located on the opposite corner of the base 54 than for the adjustable safety rest 50.

It will also be understood that a single adjustable safety rest 50 of 52 can be constructed with two recesses, each extending at an approximate 45° angle from the inner corners of the notch 70. This provides the conforming first end surface 138 on the adjustable slide 136 to be provided for each side edge of the grinding wheel 22 or 24 regardless of which side edge is subject to wear. The slides are adjustable independently with respect to the conforming grinding wheel edge to maintain the required 1-3 mm gap.

It is also possible to provide the groove 122 in line with the notch 70 generally central or intermediate the oppose sides 64 and 66 of the base 54. This provides two features. First, the entire safety rest may be fixed in a stationary position relative to the grinding wheel 22 and only the slide 136 adjusted as the front edge of the grinding wheel 22 experiences wear. Second, the central location of the groove 122 on the base plate 54 can utilize a slide 136 having a specially configured first end 138 for use with specially shaped grinding wheels, such as grinding wheels having a T-shaped slot formed in the outer edge.

The intermediate or central location of the groove 122 and the slide 136 may also be combined with either or both of the left hand and right hand angularly positioned recess 122 and slide 136 described above in a single unit.

What is claimed is:

1. An adjustable safety rest for a rotatable grinder wheel comprising:

a base mountable adjacent a grinder wheel;

a notch formed in one edge of the base and extending inward from the one edge into the base, the notch defining two sidewalls and an inner end wall, the inner end wall connected to inner edges of the sidewalls at inner corners;

a groove formed in the base, the groove having spaced sidewalls intersecting the inner end wall and one sidewall of the notch; and for adjustable positioning of a first end of a special shape member relative to the one sidewall and the inner end wall of the notch.

2. An adjustable safety rest for a rotatable grinder wheel comprising:

a base mountable adjacent a grinder wheel;

a notch formed in one edge of the base and defining two sidewalls and an inner end wall, the inner end wall connected to inner edges of the sidewalls at inner corners;

a groove formed in the base;

a special shape member adjustably movable in the groove;

the special shape member having a first end with a face substantially conformable to an existing edge shape of a grinder wheel disposed in the notch adjacent the first end; and a longitudinal axis of the groove and the special shape member intersect one of the inner corners of the notch in the base at a substantially 45° angle with respect to a plane to the grinder wheel.

3. The safety rest of claim 1 wherein:

the groove and the special shape member intersect one of inner corners of the notch.

4. The safety rest of claim 1 wherein:

a longitudinal axis of the groove and the special shape member intersect the inner end wall of the notch in the base.

5. The safety rest of claim 1 further comprising:

a mounting leg fixed to the base, the mounting leg attachable to a fixed support structure carrying a grinding wheel.

6. The safety rest of claim 5 further comprising:

a back plate having at least one threaded bore;

a slot carried in the mounting leg; and a fastener extendable through the slot into the bore in the back plate for mounting the mounting leg on the base to the fixed support structure.

7. The safety rest of claim 6 wherein:

the slot, the fastener, and the back plate cooperate to allow adjustment of the mounting leg relative to fixed support structure.

8. The safety rest of claim 1 wherein the special shape member comprises:

a slide.

9. The safety rest of claim 8 further comprising:

fasteners engageable with the slide and the base to adjustably fix the slide in a selected position along an axial extent of the groove in base.

10. The safety rest of claim 8 further comprising:

a stop member fixed to a second end of the slide for limiting movement of the slide relative to the base in one direction.

11. The safety rest of claim 8 further comprising:

the first end of the slide having an arcuate shape.

12. The safety rest of claim 10 further comprising:

the first end of the slide having a concave shape.

13. The safety rest of claim 8 further comprising:

the first end of the slide having a linear shape.

14. The safety rest of claim 1 further comprising:

the special shape member adjustably fixedly coupled to the base for adjustable repositioning of a first edge of the special shape member relative to the base to maintain a predetermined gap between the first edge of the special shape member and an adjacent edge of a grinding wheel.

15. The safety rest claim 1 further comprising:

a mount coupled to the base and adjustably positionably fixable to support structure surrounding a grinding wheel, the mount being repositionable to maintain the two side walls and the inner end wall of the notch in the base at a predetermined gap spacing from adjacent edges of a grinding wheel.

16. A grinder apparatus comprising:

a grinding wheel rotatably mounted on a spindle;

the grinding wheel having an outer peripheral edge, and opposed sidewalls joined by spaced corner edges, the corner edges subject to wear during use from new perpendicular corner edges to arcuate, non-perpendicular corner edges;

an adjustable safety rest including a base having a notch mountable adjacent a grinder wheel, the notch extending inward from one edge of the base into the base, the notch defining two sidewalls and an inner end wall, the inner end wall connected to inner edges of the sidewalls at inner corners;

a groove formed in the base, the groove having spaced sidewalls intersecting the inner end wall and one sidewall of the notch; and a special shape member with a first end, the special shape member linearly adjustably mounted in the groove for adjustable positioning of the first end of the special shape member relative to the one sidewall and the inner end wall of the notch.

17. The grinder apparatus of claim 16 wherein:

the special shape member is a slide.

18. The grinder apparatus of claim 17 further comprising:

fasteners engageable with the slide and the base to adjustably fix the slide in a selected position along the axial extent of the groove in base.

* * * * *